US007849893B2

(12) United States Patent
Lin

(10) Patent No.: US 7,849,893 B2
(45) Date of Patent: Dec. 14, 2010

(54) FLOATING CATERPILLAR FEEDER

(76) Inventor: Chin-Chi Lin, No. 473, Sanfong Road, Houli Township, Taichung County (TW)

( * ) Notice: Subject to any disclaimer, the term of this patent is extended or adjusted under 35 U.S.C. 154(b) by 183 days.

(21) Appl. No.: 12/354,005

(22) Filed: Jan. 15, 2009

(65) Prior Publication Data

US 2010/0175789 A1 Jul. 15, 2010

(51) Int. Cl.
*B27B 31/00* (2006.01)

(52) U.S. Cl. ..... 144/242.1; 144/245.1; 144/253.1; 198/731

(58) Field of Classification Search ..... 144/242.1, 144/245.1, 250.12, 250.17, 253.1, 253.5, 144/253.6; 198/728, 731, 732
See application file for complete search history.

(56) References Cited

U.S. PATENT DOCUMENTS 4,875,512 A * 10/1989 Lin ..... 144/248.4
6,289,950 B1 * 9/2001 Chiang ..... 144/117.1
6,655,429 B2 * 12/2003 Tekulve et al. ..... 144/378
2009/0049969 A1 * 2/2009 Lin ..... 83/421

* cited by examiner

*Primary Examiner*—Shelley Self
(74) *Attorney, Agent, or Firm*—Occhiuti Rohlicek & Tsao LLP

(57) ABSTRACT

A floating caterpillar feeder is used for moving a workpiece on a worktable. The feeder includes a housing unit having a bottom edge, a driving unit including two pairs of sprockets and two chains respectively trained on the pairs of the sprockets, and a plurality of feeding units connected between the chains. Each feeding unit includes two mounting members connected respectively and fixedly to two corresponding links of the chains, parallel horizontal inner and outer rods connected fixedly between the mounting members, parallel pushing plates sleeved on the inner and outer rods, and resilient members for biasing the pushing plates to project from the bottom edge. Each pushing plate has a pair of inner and outer holes engaging respectively and movably the inner and outer rods so as to allow the corresponding pushing plate to move relative to the inner and outer rods in an inner-to-outer direction.

5 Claims, 10 Drawing Sheets

FLOATING CATERPILLAR FEEDER

BACKGROUND OF THE INVENTION

1. Field of the Invention

This invention relates to a wood processing machine, and more particularly to a floating caterpillar feeder for a wood processing machine.

2. Description of the Related Art

When a wooden plate dries, it deforms to thereby have uneven side surfaces. When the deformed wooden plate is moved by a feeder under pressure on a worktable of a wood processing machine, such as a wood planing machine, not only can it not be moved smoothly, but also, the service life of the feeder is reduced.

Referring to FIGS. 1 and 2, a conventional caterpillar feeder is used for a wood planing machine, and includes a housing 1, a driving unit 2, and a plurality of feeding units 3 driven by the driving unit 2. Each feeding unit 3 includes a pair of inner and outer plates 302, 301, a plurality of support rods 303 connected fixedly between the inner and outer plates 302, 301, a plurality of pushing rods 304, and a plurality of springs 305. Each of the inner and outer plates 302, 301 has a plurality of holes 302', 301' for extension of the support rods 303 and the pushing rods 304. Each pushing rod 304 includes a rod body having a pushing end 306 disposed outwardly of the housing 1, and a retaining ring 307 sleeved fixedly on the rod body and abutting against an inner surface of the corresponding outer plate 301. Each spring 305 is disposed between the corresponding inner plate 302 and the retaining ring 307. When the feeding units 3 circulate, some of the pushing rods 304 come into frictional contact with a top surface of a wooden plate (not shown) for feeding the same at any time during circulation of the feeding units 3.

The aforesaid conventional caterpillar feeder suffers from the following disadvantages:

1. The inner and outer plates 302, 301 must be drilled to form the holes 302', 301', thereby resulting in a troublesome manufacturing process.
2. Since the holes 301', 302' are vertical when the corresponding feeding unit 3 is in contact with the wooden plate, wood shavings move upwardly into spaces between the corresponding outer plate 301 and the corresponding pushing rods 304 and between the corresponding pushing rods 304 and the corresponding springs 305, thereby affecting adversely smooth movement of the corresponding pushing rods 304 and, thus, the wooden plate.

SUMMARY OF THE INVENTION

The object of this invention is to provide a caterpillar feeder for a wood processing machine, which can be made easily and which can move a workpiece smoothly on a worktable.

According to this invention, a floating caterpillar feeder is used for moving a workpiece on a worktable. The feeder includes a housing unit having a bottom edge, a driving unit including two pairs of sprockets and two chains respectively trained on the pairs of the sprockets, and a plurality of feeding units connected between the chains. Each feeding unit includes two mounting members connected respectively and fixedly to two corresponding links of the chains, parallel horizontal inner and outer rods connected fixedly between the mounting members, parallel pushing plates sleeved on the inner and outer rods, and resilient members for biasing the pushing plates to project from the bottom edge. Each pushing plate has a pair of inner and outer holes engaging respectively and movably the inner and outer rods so as to allow the corresponding pushing plate to move relative to the inner and outer rods in an inner-to-outer direction.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
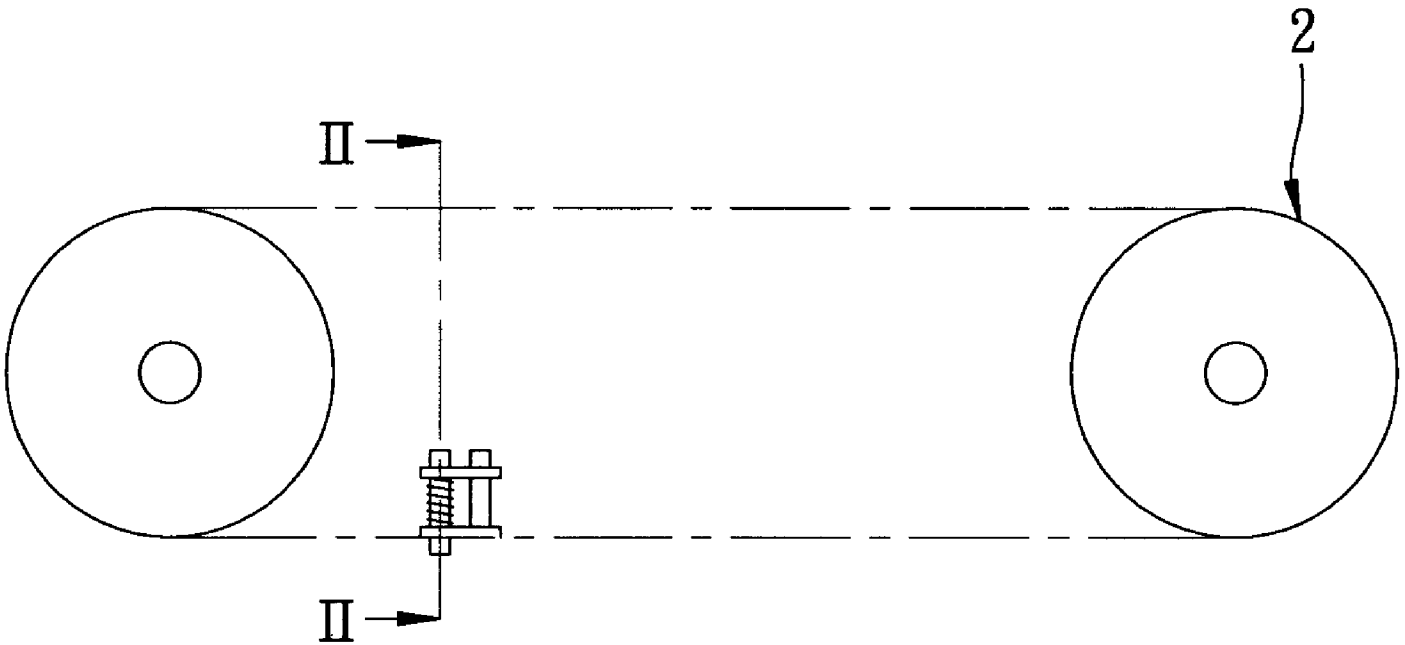
FIG. 1 PRIOR ART
FIG. 1 is a schematic view of a conventional caterpillar feeder.
Figure 2:
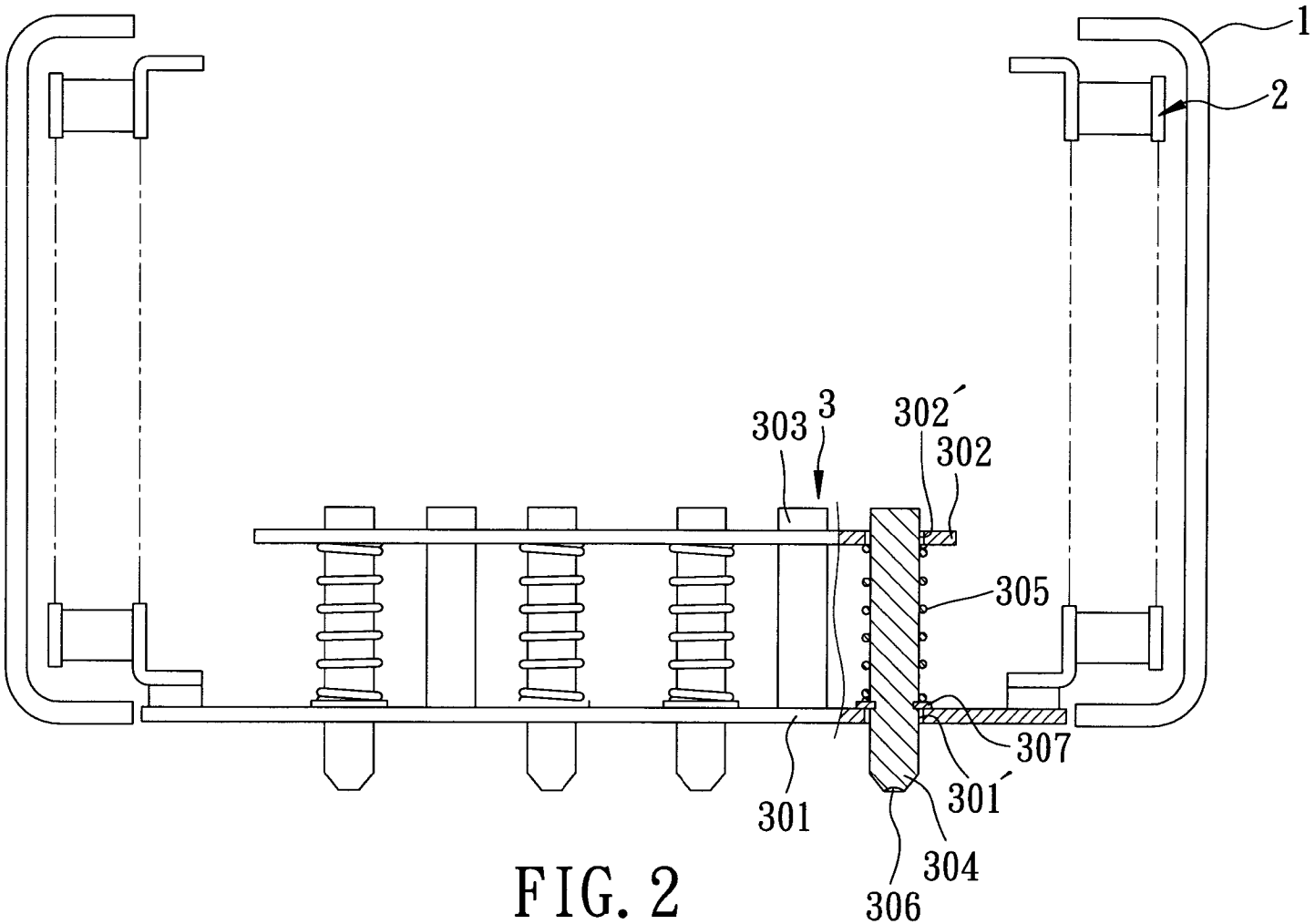
FIG. 2 PRIOR ART
FIG. 2 is a sectional view taken along line II-II in FIG. 1.
Figure 3:
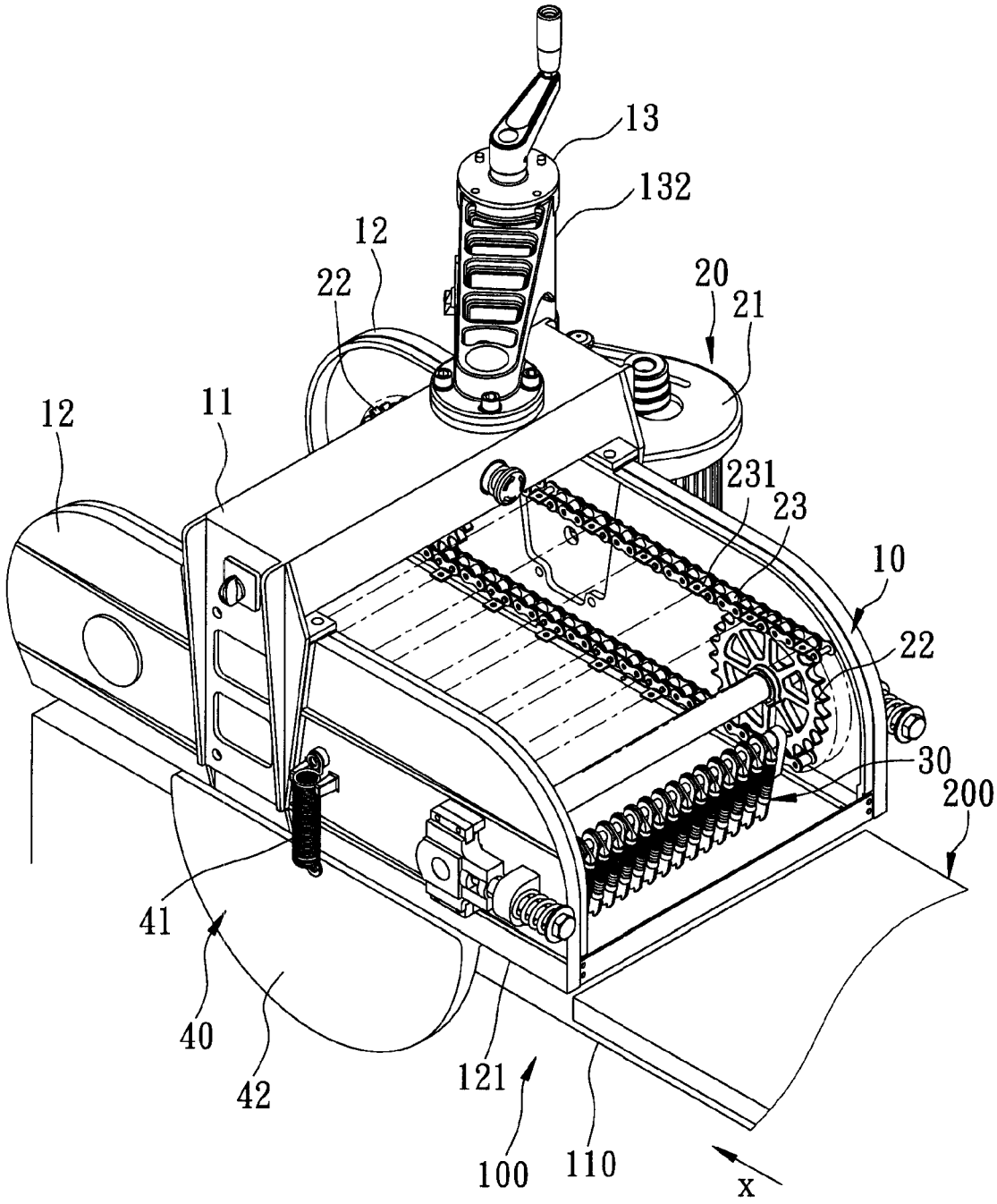
FIG. 3 is a perspective view of the preferred embodiment of a floating caterpillar feeder according to this invention.
Figure 4:
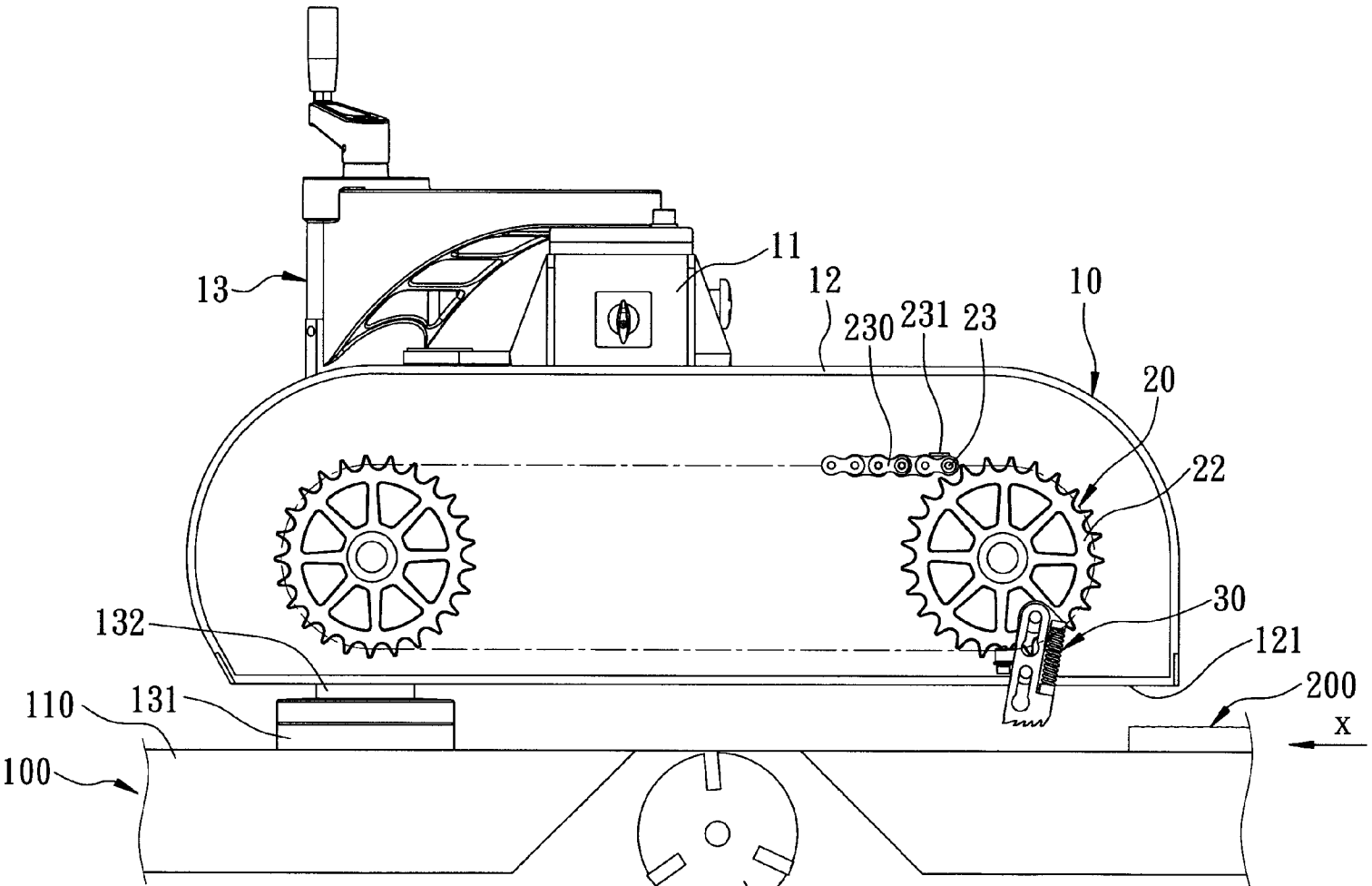
FIG. 4 is a schematic front view of the preferred embodiment.
Figure 5:
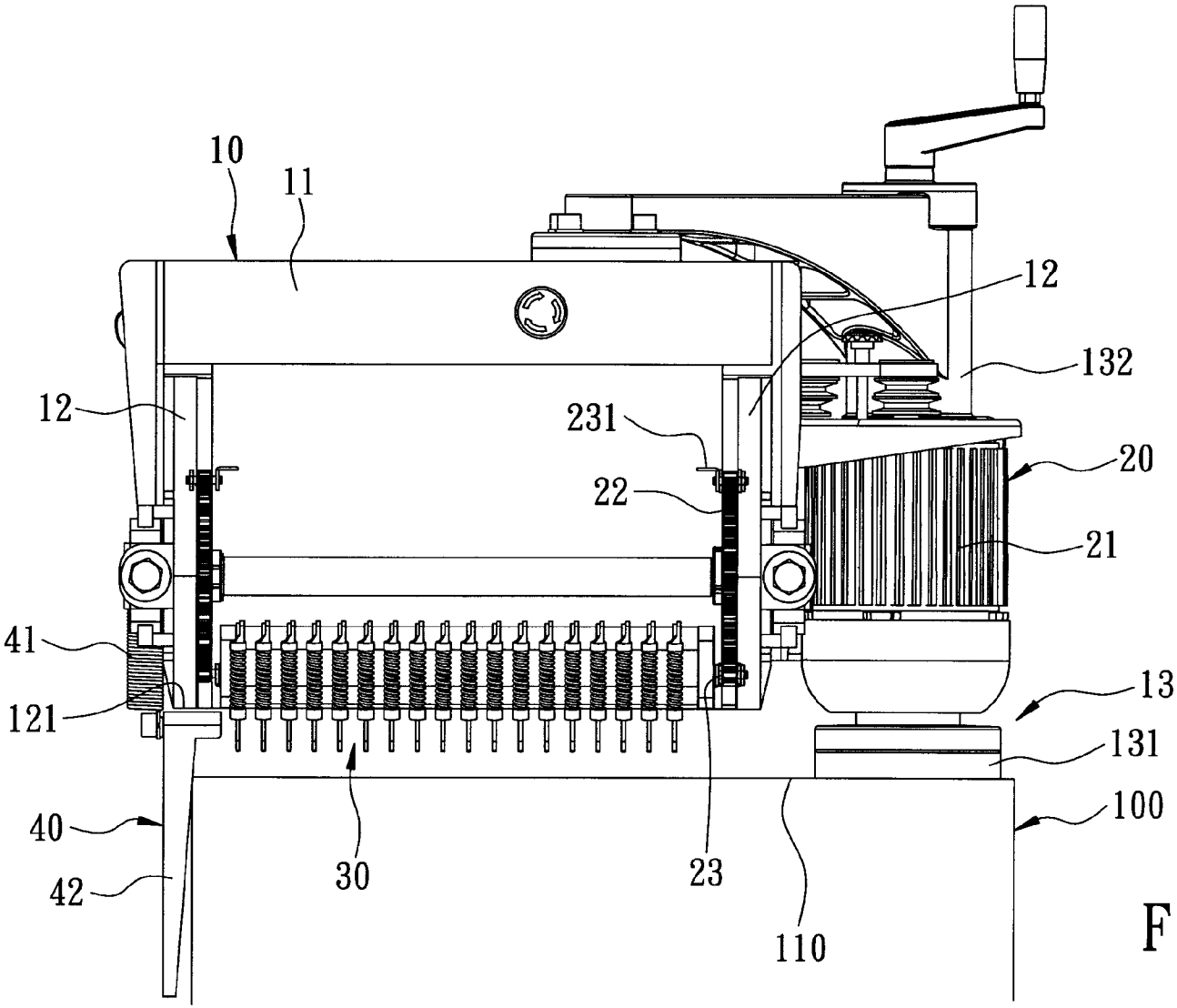
FIG. 5 is a right side view of the preferred embodiment.

Referring to FIGS. 3, 4, and 5, the preferred embodiment of a floating caterpillar feeder according to this invention is used for moving a workpiece 200, such as a wooden plate, on a worktable 110 of a wood planing machine 100 in a feeding direction (X). The wood planing machine 100 includes a cutter 120 for planing the workpiece 200. The feeder includes a housing unit 10, a driving unit 20, a plurality of feeding units 30 (only one is shown in FIG. 3), and a shielding unit 40.

The housing unit 10 includes a hanging plate 11 having an inverted U-shaped cross-section, two side plates 12 disposed respectively at two opposite sides of the housing unit 10 and connected fixedly to the hanging plate 11, and a foot frame 13 for connecting the hanging plate 11 to the worktable 110. Each side plate 12 has a straight bottom edge 121 adjacent to the worktable 110. The foot frame 13 includes a base 131 fixed on the worktable 110, and a rotary tube 132 disposed rotatably on the base 131 and connected fixedly to the hanging plate 11.

The driving unit 20 includes a motor 21 disposed on one of the side plates 12, two pairs of sprockets 22 disposed respectively and rotatably on inner surfaces of the side plates 12 and driven by the motor 21, and two chains 23 trained respectively on the pairs of the sprockets 22. Each chain 23 includes a plurality of links 230 and a plurality of positioning plates 231 each connected fixedly to a corresponding one of the links 230.

The feeding units 30 are connected between the chains 23, and are arranged along each chain 23. One feeding unit 30 will be described in the succeeding paragraphs.

Figure 6:
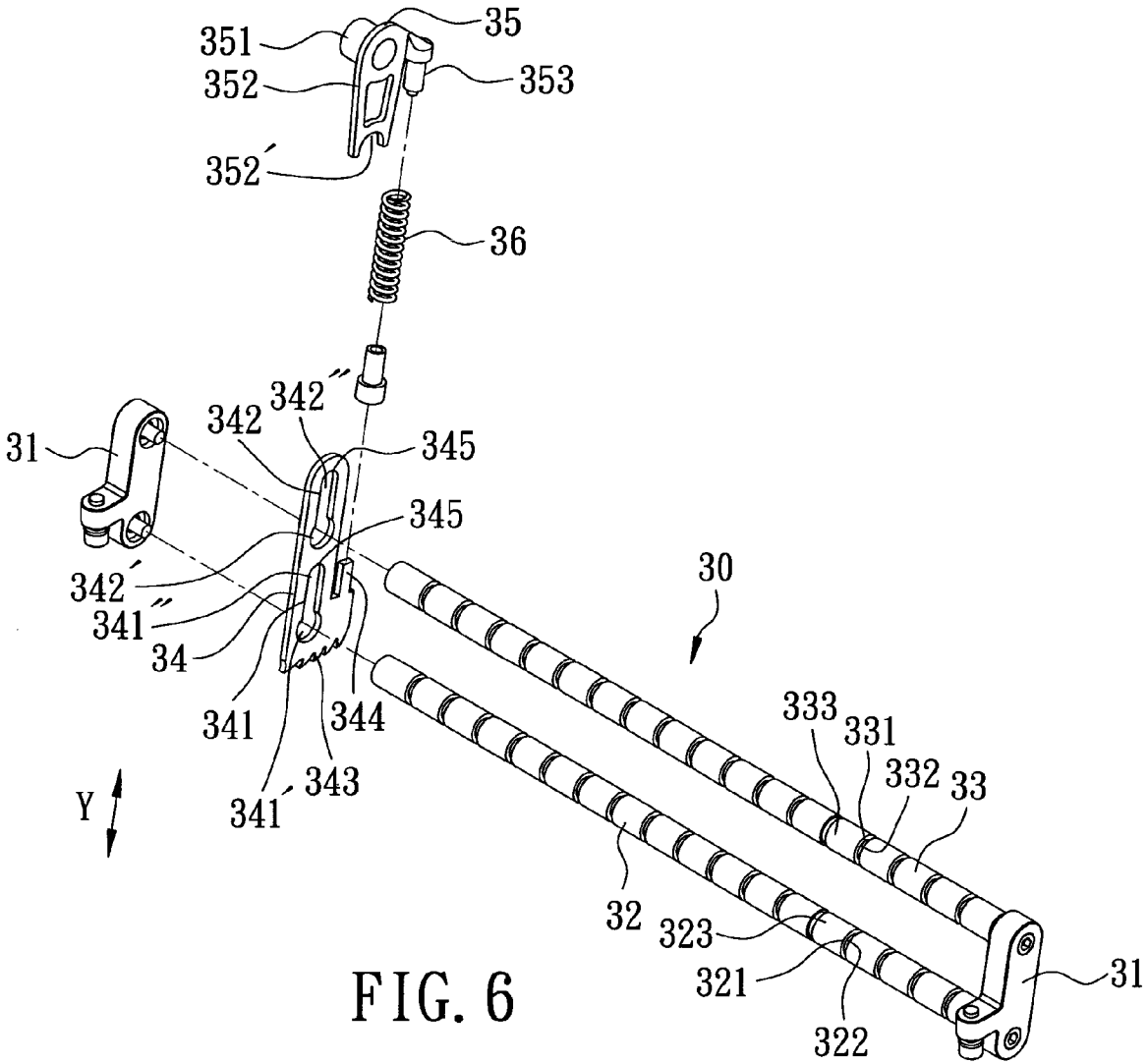
FIG. 6 is a partly exploded perspective view of a feeding unit of the preferred embodiment.
Figure 7:
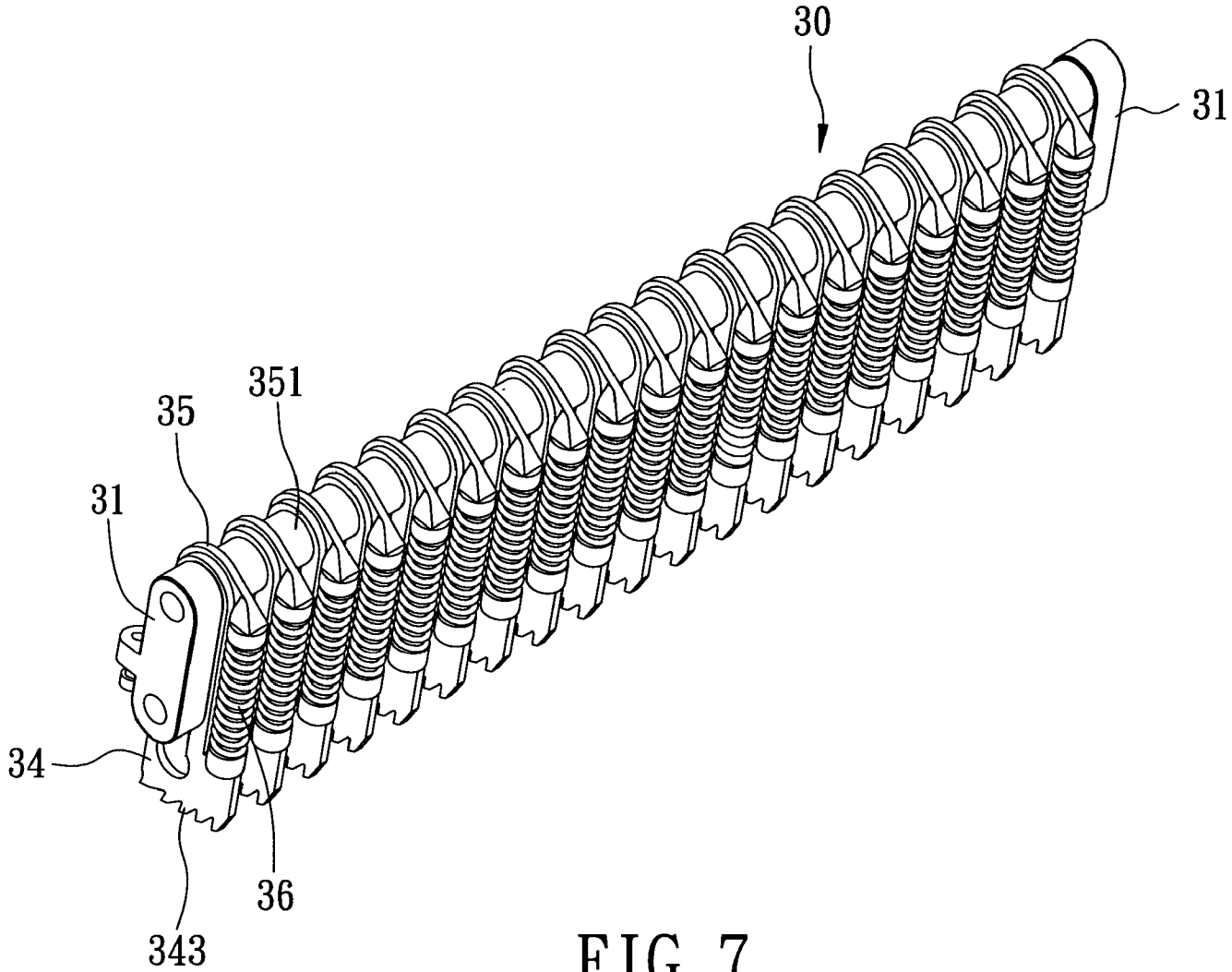
FIG. 7 is a front perspective view of the feeding unit of the preferred embodiment.
Figure 8:
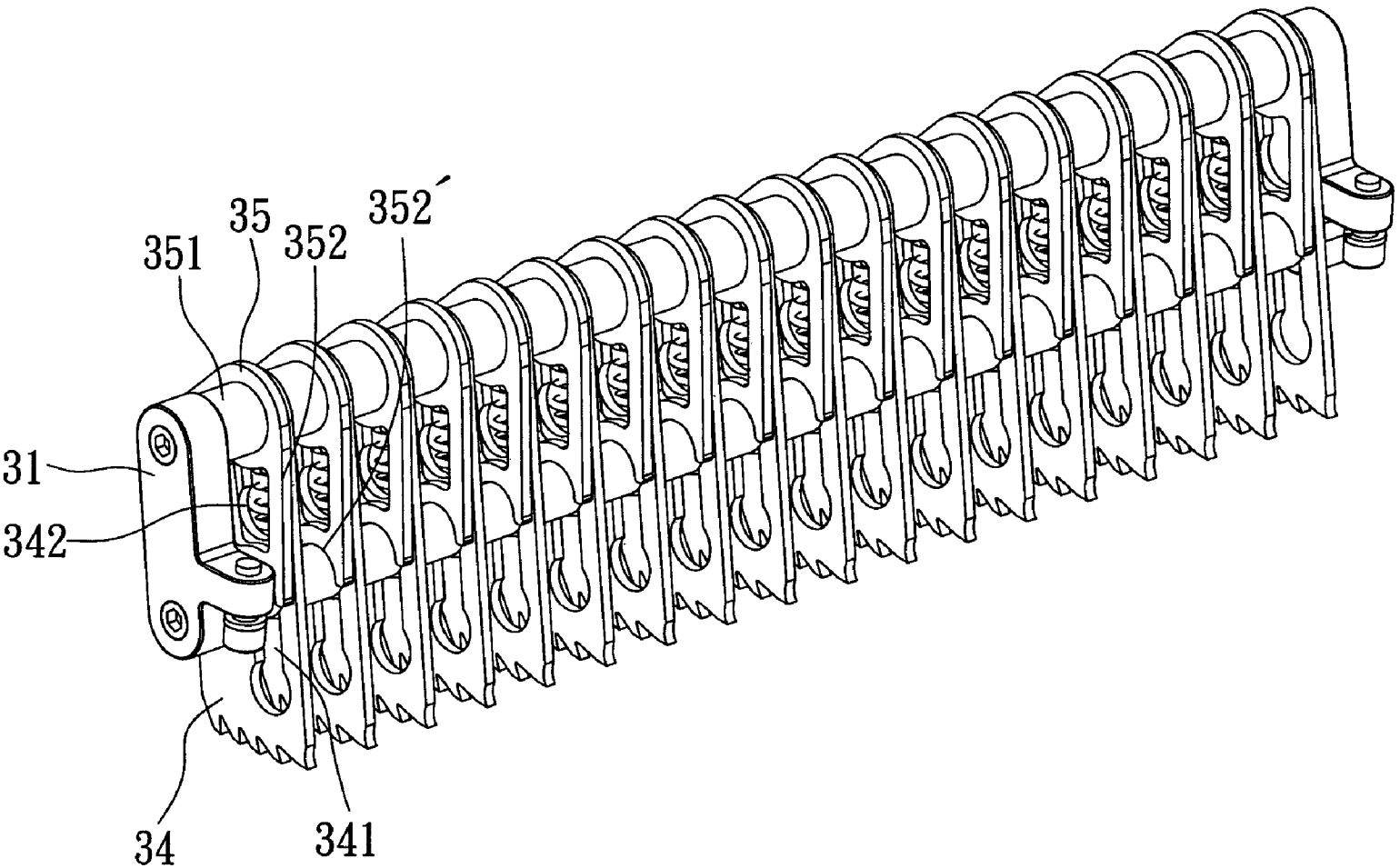
FIG. 8 is a rear perspective view of the feeding unit of the preferred embodiment.

With further reference to FIGS. 6, 7, and 8, the feeding unit 30 includes two mounting members 31 connected respectively and fixedly to two corresponding positioning plates 231, a pair of parallel horizontal inner and outer rods 33, 32 connected fixedly between the mounting members 31, a plurality of parallel pushing plates 34 sleeved on the inner and outer rods 33, 32, a plurality of spacers 35 arranged alternately with the pushing plates 34, and a plurality of resilient members 36 each biasing the corresponding pushing plate 34 to project outwardly from the bottom edges 121 when the corresponding pushing plate 34 moves along the bottom edges 121.

Each of the inner and outer rods 33, 32 has a cylindrical outer surface 333, 323 formed with a plurality of axially spaced-apart annular grooves 331, 321, each of which defines a diameter-reduced rod portion 332, 322.

Figure 9:
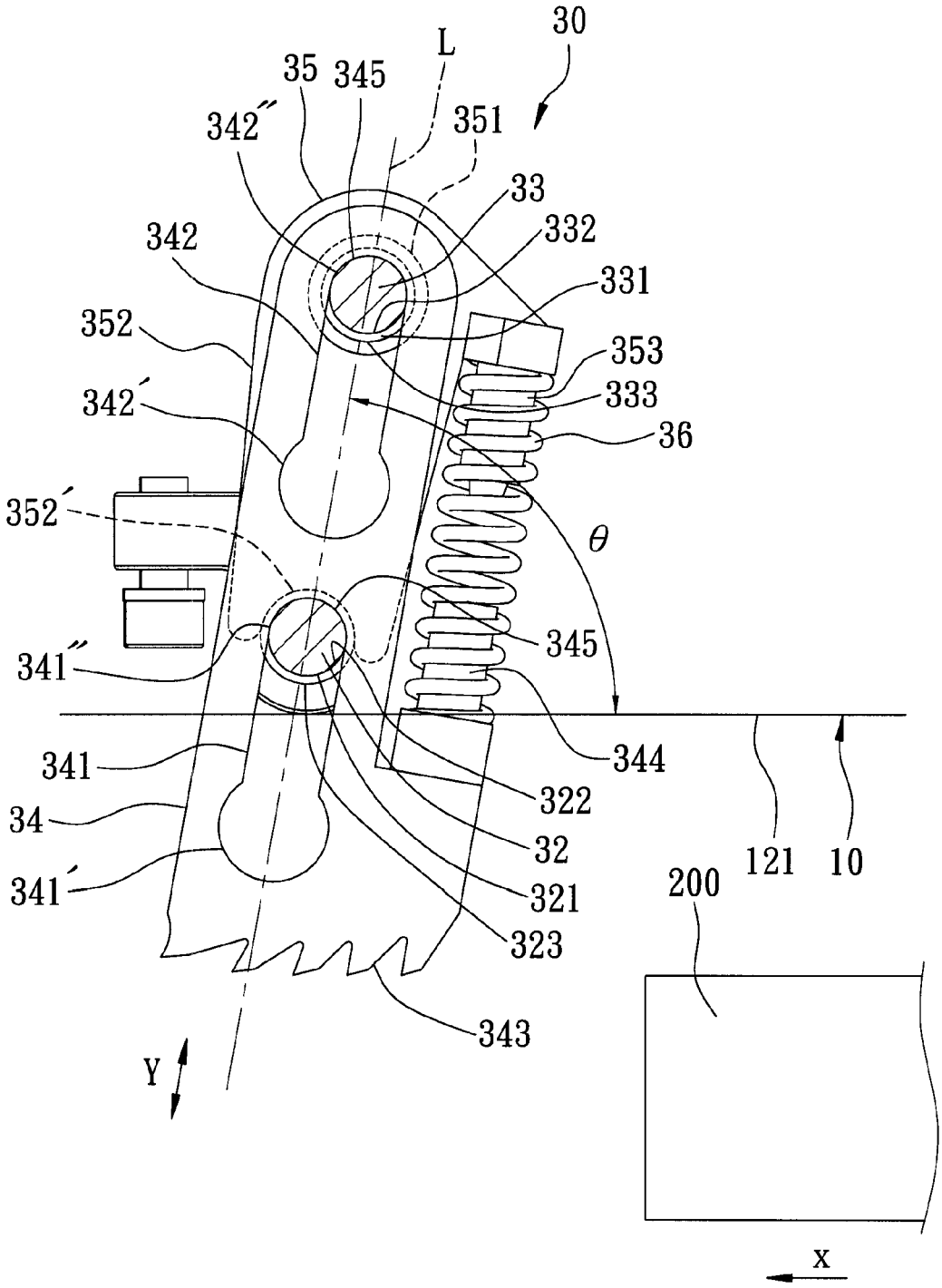
FIG. 9 is a front view of the feeding unit of the preferred embodiment.

Each pushing plate 34 has inner and outer holes 342, 341 engaging respectively the inner and outer rods 33, 32, a toothed pushing portion 343, and a lower positioning portion 344 configured as a projection. Each of the inner and outer holes 342, 341 has a generally circular wide hole portion 342', 341' allowing extension of the cylindrical outer surface 333, 323 of a corresponding one of the inner and outer rods 33, 32 during assembly, and a uniform-width narrow hole portion 342", 341" narrower than the wide hole portion 342', 341' and receiving the diameter-reduced rod portion 332, 322 of a corresponding one of the inner and outer rods 33, 32. As such, each of the inner and outer rods 33, 32 is movable along the corresponding narrow hole portion 342", 341" in an inner-to-outer direction (Y). Each narrow hole portion 342", 341" has a position-limiting end 345 distal from the corresponding wide hole portion 342', 341'. With further reference to FIG. 9, for each pushing plate 34 projecting from the bottom edges 121, an imaginary line (L) extending through the central lines of the inner and outer holes 342, 341 forms an acute angle θ with the bottom edges 121.

Each spacer 35 has a tubular portion 351 sleeved rotatably on the inner rod 33, a flat plate portion 352 connected to the tubular portion 351 and having a curved edge 352' abutting against the outer rod 32 so as to prevent rotation of the tubular portion 351 on the inner rod 33, and an upper positioning portion 353 connected to the flat plate portion 352 and configured as a projection.

Each resilient member 36 is configured as a coiled compression spring, and has two ends sleeved respectively on the upper positioning portion 353 of the corresponding spacer 35 and the lower positioning portion 344 of the corresponding pushing plate 34. As such, each resilient member 36 biases the pushing portion 343 of the corresponding pushing plate 34 to move away from the bottom edges 121 when the corresponding pushing plate 34 moves along the bottom edges 121.

The shielding unit 40 includes a resilient member 41 made of a high-rigidity metal and connected to one of the side plates 12, and a shielding plate 42 mounted to the resilient member 41. As such, the shielding plate 42 is biased to abut against a lateral side of the worktable 110 for covering the cutter 120 (see FIG. 4).

With particular reference to FIG. 9, in a situation where one pushing plate 34 projects from the bottom edges 121 and is not in contact with the workpiece 200, the inner and outer rods 33, 32 are disposed respectively at the position-limiting ends 345 of the inner and outer holes 342, 341 in the pushing plate 34.

Figure 10:
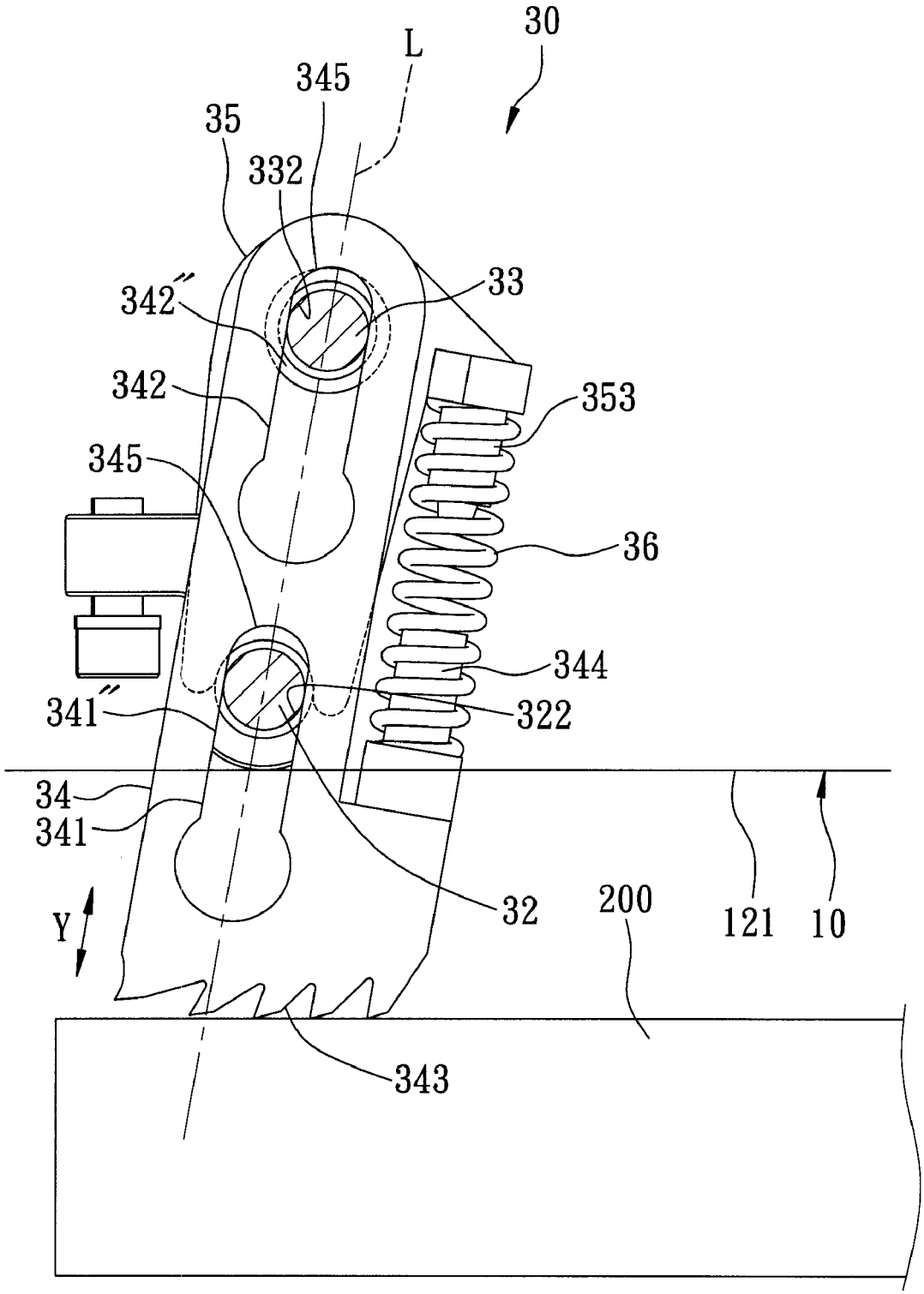
FIG. 10 is a view similar to FIG. 9 but illustrating how a pushing plate is pushed by a workpiece to move in an inner-to-outer direction.

With particular reference to FIG. 10, when the workpiece 200 is moved into contact with the pushing portion 343 projecting from the bottom edges 121, the pushing portion 343 is moved by the workpiece 200 toward the bottom edges 121 against the biasing action of the corresponding resilient member 36. Hence, the pushing portion 343 is biased by the corresponding resilient member 36 to move into contact with the top surface of the workpiece 200. In this state, the position-limiting ends 345 are spaced apart from the inner and outer rods 33, 32, respectively.

In view of the foregoing, the floating caterpillar feeder of this invention has the following advantages:

1. The pushing plates 34 are made by a pressing process, and the annular grooves 331, 321 are formed by a rolling process. Thus, the feeder can be made easily.
2. Since the inner and outer holes 342, 341 are horizontal, and each resilient member 36 is disposed between the corresponding upper and lower positioning portions 353, 344, adverse affection of wood shavings associated with the prior art is eliminated. As a result, the workpiece 200 can be moved smoothly on the worktable 110.

With this invention thus explained, it is apparent that numerous modifications and variations can be made without departing from the scope and spirit of this invention. It is therefore intended that this invention be limited only as indicated by the appended claims.

I claim:

1. A floating caterpillar feeder adapted for moving a workpiece on a worktable of a wood processing machine in a feeding direction, the feeder comprising:

a housing unit having a bottom edge adapted to be adjacent to the worktable;

a driving unit disposed on said housing unit and including a motor, two pairs of sprockets disposed respectively at two opposite sides of said housing unit and rotatable by said motor, and two chains trained respectively on the pairs of said sprockets, each of said chains having a plurality of links; and a plurality of feeding units connected between said chains and arranged along each of said chains, each of said feeding units including:

two mounting members connected respectively and fixedly to two corresponding ones of said links of said chains, a pair of parallel horizontal inner and outer rods connected fixedly between said mounting members, a plurality of parallel pushing plates sleeved on said inner and outer rods, each of said pushing plates being movable along said bottom edge and having inner and outer holes engaging respectively said inner and outer rods so as to allow a corresponding one of said pushing plates to move relative to said inner and outer rods in an inner-to-outer direction, and a pushing portion movable along with said chains to project from said bottom edge when a corresponding one of said pushing plates moves along said bottom edge, a plurality of spacers arranged alternately with said pushing plates, and a plurality of resilient members each biasing a corresponding one of said pushing plates to project outwardly from said bottom edge when the corresponding one of said pushing plates moves along said bottom edge.

2. The floating caterpillar feeder as claimed in claim 1, wherein each of said inner and outer rods of said feeding units has a cylindrical outer surface formed with a plurality of axially spaced-apart annular grooves, each of which defines a diameter-reduced rod portion, each of said inner and outer holes in said pushing plates having a wide hole portion allowing extension of said cylindrical outer surface of a corresponding one of said inner and outer rods during assembly, and a narrow hole portion narrower than said wide hole portion and receiving movably said diameter-reduced rod portion of the corresponding one of said inner and outer rods.

3. The floating caterpillar feeder as claimed in claim 2, wherein each of said pushing plates of said feeding units further has a lower positioning portion, each of said spacers having a tubular portion sleeved rotatably on said inner rod of a corresponding one of said feeding units, a flat plate portion connected to said tubular portion and abutting against said outer rod of the corresponding one of said feeding units such that rotation of said tubular portion on said inner rod of the corresponding one of said feeding units is prevented, and an upper positioning portion connected to said flat plate portion, each of said resilient members having two ends abutting respectively against said upper positioning portion of a corresponding one of said spacers and said lower positioning portion of a corresponding one of said pushing plates.

4. The floating caterpillar feeder as claimed in claim 1, wherein said bottom edge of said housing unit is straight, an imaginary line extending through central lines of said inner and outer holes in each of said pushing plates of said feeding units forming an acute angle with said bottom edge when said pushing portion of a corresponding one of said pushing plates projects from said bottom edge.

5. The floating caterpillar feeder as claimed in claim 1, further comprising a shielding unit that includes a resilient member made of metal and connected to said housing unit, and a shielding plate mounted to said resilient member such that said shielding plate is biased to abut against the worktable.

* * * * *